US005452691A

United States Patent [19]

Nilsson et al.

[11] Patent Number: 5,452,691

[45] Date of Patent: Sep. 26, 1995

[54] CYLINDER LINER SUPPORT ARRANGEMENT

[75] Inventors: Per-Inge Nilsson, Vagnhärad; Eine Wallin, Södertälje, both of Sweden

[73] Assignee: Saab Automobile Aktiebolag, Sweden

[21] Appl. No.: 267,144

[22] Filed: Jun. 27, 1994

[30] Foreign Application Priority Data

Jun. 30, 1993 [SE] Sweden ..... 9302245

[51] Int. Cl.[6] ..... F01B 11/02; F02B 75/08

[52] U.S. Cl. ..... 123/193.2; 123/195 R

[58] Field of Search ..... 123/193.1, 193.2, 123/41.83, 41.84, 195 R

[56] References Cited

U.S. PATENT DOCUMENTS

| | | | |
|---|---|---|---|
| 2,436,729 | 2/1948 | Paxman . | |
| 4,391,238 | 7/1983 | Greier et al. . | |
| 4,699,100 | 10/1987 | Leydorf et al. | 123/193.3 |
| 4,856,462 | 8/1989 | Ushio et al. | 123/41.84 |
| 5,005,469 | 4/1991 | Ohta | 123/41.84 |
| 5,025,757 | 6/1991 | Larsen | 123/48 R |
| 5,148,782 | 9/1992 | Kramer et al. | 123/195 R |
| 5,315,970 | 5/1994 | Rao et al. | 123/193.2 |

FOREIGN PATENT DOCUMENTS

| | | |
|---|---|---|
| 3639850 | 5/1988 | Germany . |
| 2058912 | 9/1980 | United Kingdom . |

*Primary Examiner*—Marguerite Macy
*Attorney, Agent, or Firm*—Ostrolenk, Faber, Gerb & Soffen

[57] ABSTRACT

A cylinder liner support arrangement in an internal combustion engine, preferably in which the cylinder block and cylinder head are integrated in a common monobloc element and the cylinder barrels for the engine pistons have cylinder liners which have their upper portions inserted in cylinder bores in the cylinder block. The lower portions of the cylinder liners are accommodated in cylindrical apertures in a common cylinder liner support which may be made as a single element and is removably secured to a lower surface of the cylinder block. The cylinder liner support includes a number (corresponding to the number of cylinders of the engine) of mutually connected supporting sleeves which are disposed in-line, delineate the cylindrical apertures and have their sleeve walls surrounding the lower portions of the cylinder liners and providing them with lateral support. The cylinder liner support includes a mounting plate from one side of which the supporting sleeves protrude. Along the side edges of the mounting plate fastening holes are provided to accommodate screws for screwing the cylinder liner support securely to the lower surface of the cylinder block.

15 Claims, 3 Drawing Sheets

CYLINDER LINER SUPPORT ARRANGEMENT

BACKGROUND OF THE INVENTION

The present invention relates to a cylinder liner support arrangement in an internal combustion engine, and particularly an internal combustion engine having at least two in-line combustion chambers.

The cylinder liner support of the invention is particularly intended for use in internal combustion engines in which the cylinder block (engine block) and associated cylinder head are made in a single continuous piece, commonly called a monobloc element or simply a monobloc. In such an engine, the cylinder liners (which form cylinder barrels for the pistons) have their upper portions inserted in cavities (cylinder bores) in the cylinder block.

The cylinder liner support of the invention may nevertheless also be used in internal combustion engines in which the cylinder block is separate from the cylinder head, in which case the cylinder liner support is separate from the crankshaft retaining portion (crankcase) of the engine.

In a conventional internal combustion engine in which the cylinder block (engine block) and cylinder head (top cap) are separate elements, the cylinder head is fastened on top of the cylinder block by means of studbolts or other types of fastening screws. The valve seat machining required for such a conventional engine involves no great difficulties, since in this case the valve seats are situated in the "roof" of the combustion chamber, i.e., on the underside of the cylinder head. This makes the valve seats readily accessible for machining from the underside of the cylinder head.

In the contrasting case of internal combustion engines of the kind indicated in the introduction, i.e., monobloc engines in which the cylinder head and cylinder block consist of a single undivided constructional element, valve seat machining involves great difficulties. This is because, in this case, the valve seats are situated deep inside the monobloc, more precisely in the roof of the combustion chamber, i.e., at the top of the respective cylinders. The valve seats are thus situated just above the extreme top ends of the cylinders, i.e., just above the extreme top ends of the cylinder bores which are incorporated in the monobloc and in which the cylinder liners have to be fastened.

Machining the valve seats in this case has to be done by means of tools introduced into the monobloc from below, more precisely, up through the cylinders/cylinder bores in the monobloc. As machining the valve seats in such an engine does, of course, take place before the cylinder liners have been fitted in the cylinder bores, the "working distance" through a cylinder bore is not as great as the axial length of the cylinder liner, which is longer, and is determined instead by the total axial length of the actual cylinder bore or the portions of the monobloc which form the receiving cavity and support for the cylinder liner. The axial working distance available for valve seat machining, calculated upwards from the underside of the lowest portions of the monobloc in the region of the cylinders, will certainly be smaller if only a shorter upper portion of the cylinder liner has to be fastened in and provided with support, but at least the upper half of the cylinder liner has, for thermal and strength reasons, to be liquid-cooled (water-cooled), i.e., fixed in a cavity which is surrounded by cooling liquid ducts in the region of the monobloc which forms the cylinder block portion.

Previously known from U.S. Pat. No. 4,294,203 is an internal combustion engine of monobloc type in which the cylinder head and cylinder block consist of one integrated element and the cavity in the engine which accommodates each cylinder liner is divided into an upper portion situated in the monobloc and a lower portion situated in an upwardly extended reinforced upper portion of the engine crankcase. However, an obvious disadvantage of such a design solution is that it requires a heavier crankcase portion which will also be of more complicated design and therefore more expensive to produce.

SUMMARY OF THE INVENTION

An object of the present invention is to provide for the lower portions of the cylinder liners a single support which is separate from the engine crankshaft portion and is removably fastened only to a lower surface of the cylinder block, resulting in the cylinder liner support only needing to be optimized/ dimensioned for the piston side forces and the relatively low thermal loads to which the lower portions of the liners are subjected. Making the lower liner support common to at least two cylinder liners disposed in-line results in a local stiffening of the engine block in its longitudinal direction and a simpler assembly with fewer parts.

Another object of the present invention is to provide in a monobloc engine a cylinder liner support arrangement with a cylinder liner support which is common to all the cylinder liners of the engine, is made as a separate element and is fitted to the underside of the cylinder block portion of the monobloc.

A further object of the invention is specifically related to a type of engine design which is based on a new principle, is very promising from several automotive engineering points of view, has been produced and developed in recent years and has the distinguishing feature that engine compression can be varied. An example of this new type of engine is known from international patent application publication WO 92/09798, which describes an internal combustion engine in which, by means of a hinge pin mounting on one side of the cylinder block, the engine upper portion consisting of the cylinder block and cylinder head is tiltably mounted on the engine crankcase portion (which accommodates the crankshaft) to make it possible to vary the engine compression by lateral inclination (tilting sideways) of the engine upper portion relative to the crankcase portion.

An object of the invention in connection with this new type of engine, having an engine upper portion in the form of a monobloc element (comprising cylinder block with integrated cylinder head), is to avoid the valve machining difficulties which are particularly relevant to precisely this type of engine, especially if the hinge pin mounting and the tilting mechanism which is situated on the opposite side of the engine include bearing lugs which constitute integrated portions of the monobloc element. These bearing lugs are placed beneath the underside of the monobloc element, thereby causing further hindrance to valve seat machining.

The invention makes it possible to use and machine valve seats for significantly more angled valves in a manner which would otherwise be impossible.

The fact that the engine upper portion can be inclined (tilted) sideways relative to the crankcase portion means that in this type of engine it is not merely desirable but absolutely necessary to use a cylinder liner support arrangement which is entirely independent of the crankcase portion, since the distance between the latter and the cylinder liners will specifically change depending on the lateral inclination of the upper part of the engine.

A further object of the invention is that the cylinder liner support has to be so designed and be capable of being made of such material that its cooling and the consequent cooling of the lower portions of the cylinder liners accommodated in it can be achieved in a fully satisfactory manner simply by crankcase ventilation so that cooling liquid ducts in the cylinder liner support are not necessary.

The above-mentioned objects are achieved according to the invention by a cylinder liner support arrangement in an internal combustion engine having at least two cylinder-shaped combustion chambers disposed in-line in a cylinder block, the combustion chambers being lined with cylinder liners which have upper portions inserted in cavities in the cylinder block delineated upwardly by a cylinder head, a crankshaft portion accommodating a crankshaft being connected to the lower portion of the cylinder block, and further wherein lower portions of each cylinder liner for at least two combustion chambers disposed in-line are accommodated in cylindrical apertures in a common cylinder liner support, the cylinder liner support comprising an element separate from the engine crankshaft portion, the liner support being removably fastened to a lower surface of the cylinder block and having supporting sleeves which are connected together, the supporting sleeves being delineated by the cylindrical apertures and having sleeve walls surrounding the lower portions of the cylinder liners providing said liners with lateral support.

In such a design, the lower portions of the cylinder liners for at least two combustion chambers disposed in-line are accommodated in cylindrical apertures in a cylinder liner support common to them all, which preferably is made as a single element and is removably fastened to the underside of the cylinder block portion of the monobloc. The cylinder liner support also has a number of mutually connected supporting sleeves which advantageously correspond to the number of cylinders in the engine. In a six-cylinder or four-cylinder in-line engine, the cylinder liner support preferably has, respectively, six or four supporting sleeves disposed in-line, the cylindrical apertures of the sleeves accommodating the lower portions of the cylinder liners. The walls of the supporting sleeves thus surround the lower portions of the cylinder liners and provide them with lateral support. The invention is also applicable to so-called vee-engines.

The invention is not limited to cylinder liner supports made as a single element for in-line engines. In in-line engines with four and six cylinders respectively, the cylinder liner support may therefore be divided, respectively, into two or alternatively three separate cylinder liner supports. In engines with two obliquely set banks of cylinders, so-called vee-engines, a similar division may be applied within the respective banks of cylinders.

The cylinder liner support is preferably an engine part made separately in the form of a single element, the supporting sleeves of which provide lower cylinder liner support for all the cylinder liners in the same bank of cylinders. Each cylinder liner has its upper portion pressed into a cylinder bore in the cylinder block and its lower portion pressed into one of the supporting sleeves in the cylinder liner support. The oblong cylinder liner support is secured to the underside of the cylinder block by being screwed on from underneath.

In one embodiment according to the invention, a design is provided specially intended for an engine in which the cylinder block is integrated with the cylinder head in a so-called monobloc element. A specific version is described which makes it possible to vary the compression of the engine as a result of the monobloc element being tiltably mounted on the engine crankcase portion (which accommodates the crankshaft) by means of a hinge pin mounting on one side of the cylinder block.

It is advantageous for the cylinder liner support to include an oblong mounting plate from one side of which the supporting sleeves protrude perpendicularly to the mounting plate. On both sides of the row of supporting sleeves there are fastening holes in the edges of the mounting plate. The cylinder liner support is fastened to the underside of the cylinder block by means of screws through these fastening holes.

According to the invention, a preferred positioning of the fastening holes is at the edge of the mounting plate. In this version, the fastening holes are placed in the edges of the mounting plate at positions which are situated centrally between each pair of mutually connected supporting sleeves. In addition, the mounting plate is provided with fastening holes in its four free corner portions. The cylinder liner support is machined together with the corresponding portions of the monobloc in order to create a proper fit for the cylinder liners. The increased rigidity of the cylinder liner support resulting from it being made as a single element for two or more combustion chambers makes it easier for the necessary machining to be kept within preferably the press-fit dimensions of the cylinder liners.

The oblong straight cylinder liner support resembles a kind of "loaf" and it is advantageous for it to be made of the same material as the monobloc element. An advantageous material for the purpose is aluminum. The cylinder liner support is preferably cooled only by the crankcase gases but may have conventional cooling by means of internal ducts in the liner support. The cylinder liner upper portions fixed in the cylinder block portion of the monobloc have conventional cooling by means of cooling liquid ducts in the monobloc. The machining of the valve seats is carried out before the cylinder liner support and the cylinder liners are fitted to/in the monobloc. The cylinder liner support is required not only to protect the liners from deformation by piston side forces but also to protect the liners from being unevenly deformed along their length by the fitting operation (preferably press-fitting) required for securing and heat conduction purposes.

Making the cylinder liner support of the same material as the monobloc element eliminates such deformations which would result from uneven thermal expansion of the cylinder liner support and the monobloc element.

BRIEF DESCRIPTION OF THE DRAWINGS

The invention is described and explained further below with reference to an embodiment illustrated in the accompanying drawings, in which.

DETAILED DESCRIPTION OF THE INVENTION

Figure 1:
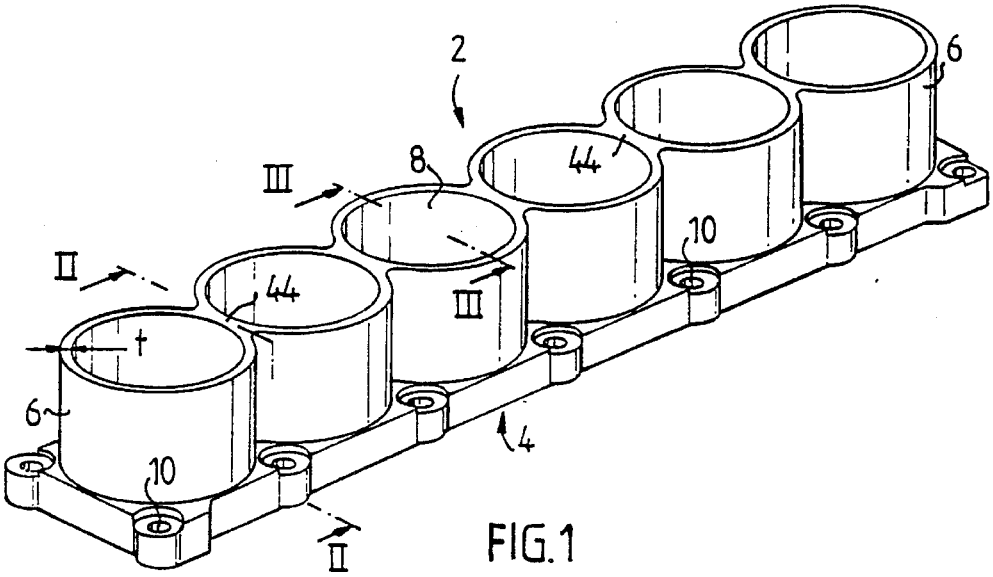
FIG. 1 is a perspective view of a cylinder liner support according to the invention which is intended for a six-cylinder in-line engine.

FIG. 1 is a perspective view of a cylinder liner support 2 which is intended for a six-cylinder in-line engine and includes an oblong mounting plate 4 at one end of which six mutually connected supporting sleeves 6 disposed in-line protrude perpendicularly to the plane of the mounting plate 4. The mounting plate 4 and the supporting sleeves 6 are preferably made in the form of a single integrated casting. Alternatively, the mounting pate 4 and the supporting sleeves 6 may be made as separate parts but be preassembled to form a single combined element. The supporting sleeves 6 have cylindrical apertures 8 through them which open out on the underside (not visible in FIG. 1) of the mounting plate 4. The mounting plate 4 has fastening holes 10 through its longitudinal side edges and its four corners. The fastening holes 10 are intended for screwing the cylinder liner support 2 securely to the underside of the engine upper portion 12 shown in FIGS. 2–4, see, in particular, FIG. 2 which shows the cylinder liner support 2 in section at the section point II—II in FIG. 1.

Figure 2:
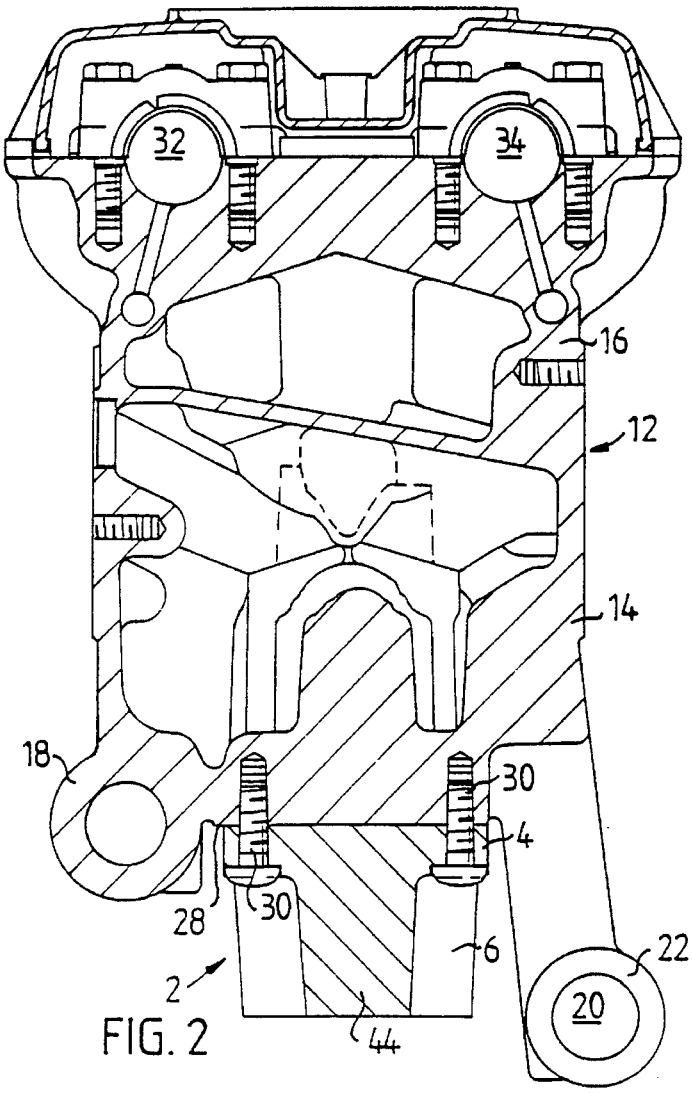
FIG. 2 shows a vertical section through an engine upper portion which is made in the form of a monobloc element, is provided with tilt mountings, has a cylinder liner support (shown sectioned along lines II—II of FIG. 1) fitted underneath it and is intended to be tiltably mounted on an undepicted crankcase portion.
Figure 4:
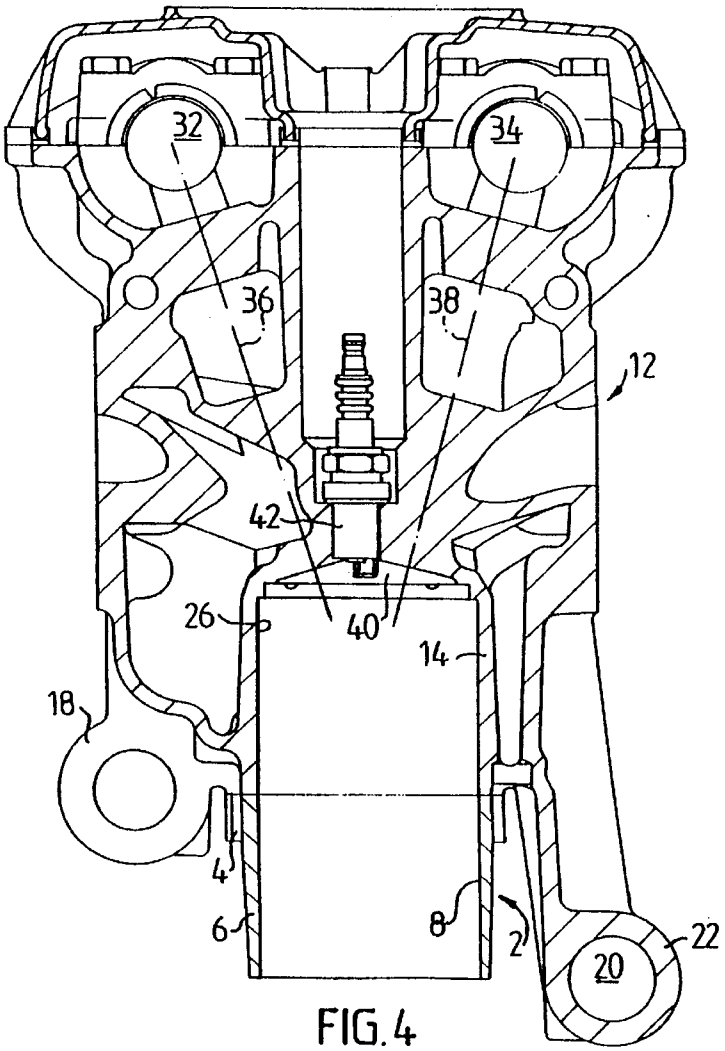
FIG. 4 shows a vertical section through the engine upper portion shown in FIGS. 2 and 3, which in this case is depicted with a cylinder liner support (also cut along lines III—III of FIG. 1) fitted but no cylinder liner inserted.
Figure 3:
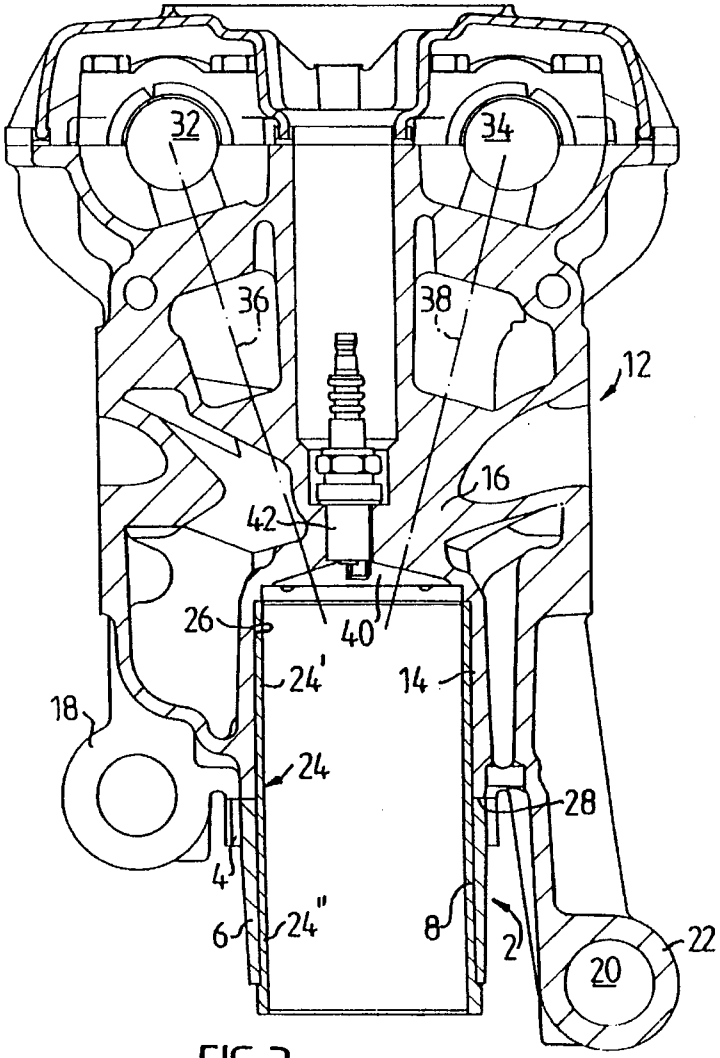
FIG. 3 shows a vertical section through the engine upper portion shown in FIG. 2, which has a cylinder liner support (shown sectioned along lines III—III of FIG. 1) fastened to it and cylinder liners inserted.

Now referring to FIGS. 2–4, these figures show vertical sections through the engine upper portion 12 (which takes the form of a monobloc structure) of an internal combustion engine provided with a cylinder liner support 2 according to FIG. 1. In the engine depicted, the cylinder block 14 with associated cylinder head 16 are parts of the same monobloc element forming the engine upper portion 12. The monobloc element 12 is provided on one side with bearing lugs 22 for an undepicted hinge pin (through the bearing hole 20) whereby the monobloc element 12 is tiltably mounted on the undepicted engine crankcase portion which accommodates the crankshaft. On its opposite side, the monobloc element 12 is provided with lowered bearing lugs 18 for an undepicted tilt mechanism which makes it possible to vary the compression of the engine by altering the angle of inclination or lateral tilt of the engine upper portion 12 relative to the undepicted crankcase portion. The bearing lugs 18 and 22 on the opposing longitudinal sides of the engine upper portion 12 are integrated with the latter as parts of the same monobloc element. FIGS. 2–4 show only one bearing lug on each side of the engine upper portion but there are, of course, a number of such bearing lugs on each side of the engine.

Now referring to FIG. 3, this figure shows a vertical section through the cylinder liner support 2 at a section point corresponding to that denoted by III—III in FIG. 1. The cylinder barrels situated in the engine upper portion 12 for the six undepicted pistons of the engine consist of six cylinder liners 24 which have their upper portions 24' inserted in cavities of cylinder bores 26 in the cylinder block portion 14 of the monobloc element 12. The lower portions 24" of the cylinder liners 24 are accommodated in the cylindrical apertures 8 in the cylinder liner support 2 which is screwed firmly to a flat lower surface 28 of the cylinder block portion by means of screws 30 (see FIG. 2). The walls of each supporting sleeve 6 surround the pertinent lower portion 24" of the cylinder liner 24, thereby providing the latter with lateral support.

In FIGS. 3 and 4, the engine shown has two overhead camshafts designated 32 and 34 respectively. The directions of movement of the valves operated by them are denoted by the chain-dotted lines 36 and 38 respectively. The valves open and close inlet and exhaust ducts which open in the "roof" of the respective combustion chamber 40. The fuel/air mixture in the combustion chamber 40 is ignited by means of an ignition plug 42.

Reverting now to FIG. 1, it may be seen that the fastening holes 10 in the edges of the mounting plate 4 are placed in pairs on opposite side edges of the mounting plate. Each such pair of fastening holes is thus situated in a plane (corresponding, for example, to the section plane II—II) which is perpendicular to the mounting plate and to the direction of the row of supporting sleeves and which passes centrally through the sleeve wall portion 44 which is common to a pair of mutually connected supporting sleeves 6. The smallest thickness of this common wall portion 44 is preferably at least as great as the sleeve wall thickness elsewhere of the supporting sleeves 6.

Figure 5:
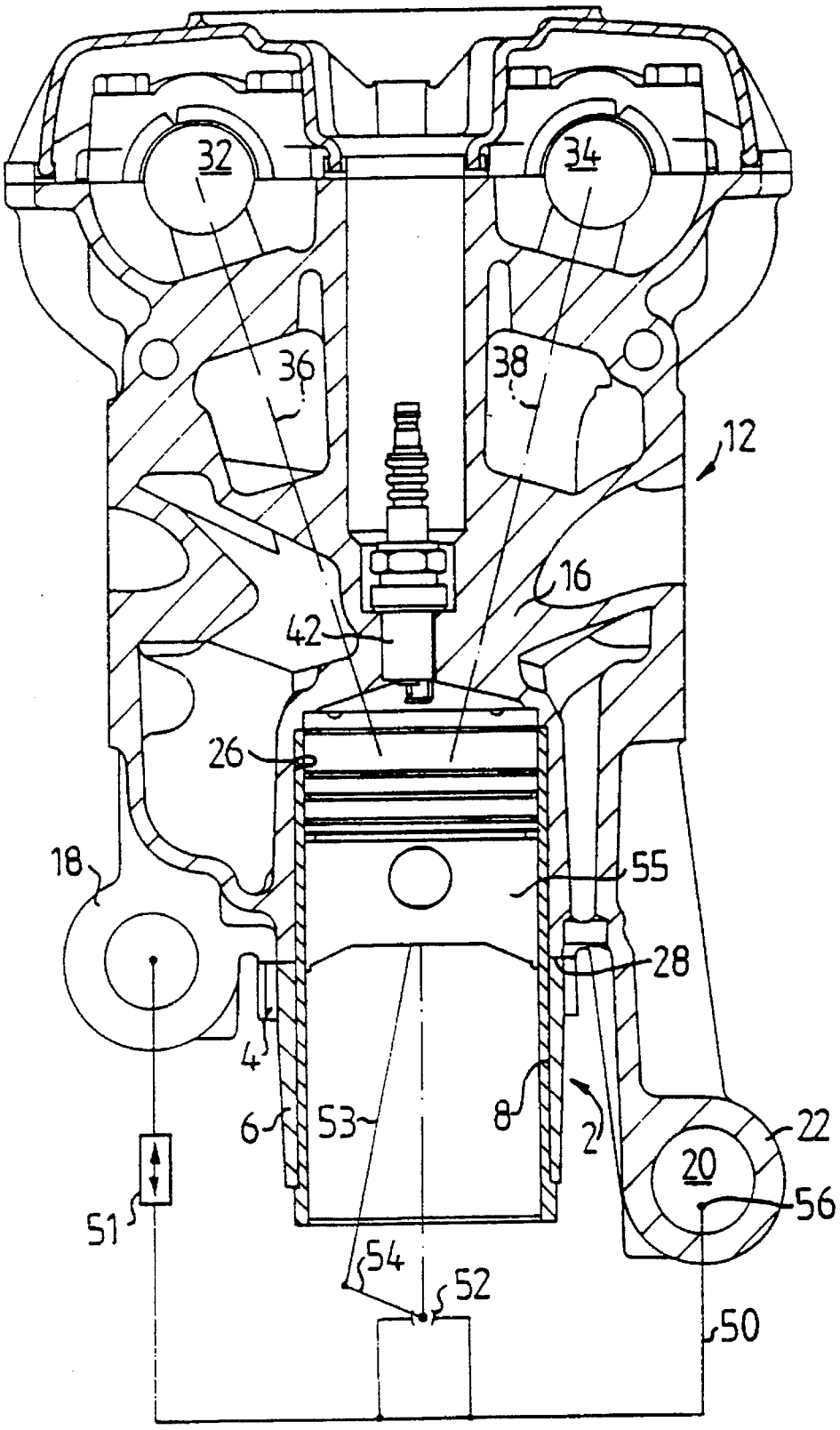
FIG. 5 shows a section corresponding to FIG. 3 but with a piston and showing schematically the crankcase portion attached to the cylinder portion.

FIG. 5 shows the engine with a schematically drawn crankcase portion 50 which includes a crankshaft bearing 52, the hinge pin 56 and an adjusting mechanism 51 for tilting the cylinder portion 14 relative to the crankcase portion 50. The crankshaft bearing 52 supports a crankshaft with a crank 54 which acts on the connecting rod 53 so that an upward and downward movement can be imparted in a conventional manner to a piston 55 borne by the connecting rod 53. The cylinder liner support 2 is not connected to the crankshaft portion 50. Instead it is only connected to the lower surface 28 of the cylinder block 14 and is thus separate from the crankshaft portion 50. The cylinder liner support 2 is consequently not acted upon by forces from the crankshaft portion and may therefore be only dimensioned to absorb piston side forces and to retain the cylinder liners, possibly only by means of press fitting. The bearings 18, 22 which connect the cylinder portion 14 to the crankshaft portion 50 are disposed radially externally around the cylinder liner support and the cylindrical liners disposed in the cylinder liner support.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A cylinder liner support arrangement in an internal combustion engine having at least two cylinder-shaped combustion chambers disposed in-line in a cylinder block, the combustion chambers being lined with cylinder liners which have upper portions inserted in cavities in the cylinder block delineated upwardly by a cylinder head, a crankcase portion accommodating a crankshaft being connected to the lower portion of the cylinder block, and further wherein lower portions of each cylinder liner for at least two combustion chambers disposed in-line are accommodated in cylindrical apertures in a common cylinder liner support, the cylinder liner support comprising an element separate from the engine crankcase portion, the liner support being removably fastened to a lower surface of the cylinder block and having supporting sleeves which are connected together, the supporting sleeves being delineated by the cylindrical apertures and having sleeve walls surrounding the lower portions of the cylinder liners providing said liners with lateral support, but not surrounding entire lengths of the cylinder liners.

2. The arrangement according to claim 1, wherein the lower portions of the cylinder liners are accommodated in cylindrical apertures in said cylinder liner support, said support being made as a single element and having a plurality of mutually connected supporting sleeves disposed in-line which correspond to the number of cylinders of the engine.

3. The arrangement according to claim 1, wherein the cylinder block and cylinder head of the internal combustion engine form an integral monobloc element, the cylinder block being connected to the crankcase portion by anchoring devices situated radially around the outside of the cylinder liner support.

4. The arrangement according to claim 3, whereby variation of the compression of the engine is provided by the monobloc element being tiltably mounted on the engine crankcase portion by a hinge pin mounting on one side of the cylinder block and a tilt mechanism on the opposite side, the removable cylinder liner support including an oblong mounting plate having one side on which the supporting sleeves protrude perpendicularly to the mounting plate and having on both sides of the row of supporting sleeves, fastening holes through the edges of the mounting plate to accommodate screws for screwing the mounting plate and hence the cylinder liner support securely to the lower surface of the cylinder block.

5. The arrangement according to claim 3, wherein the removable cylinder liner support includes an oblong mounting plate having one side on which the supporting sleeves protrude perpendicularly to the mounting plate and having on both sides of the row of supporting sleeves, fastening holes through the edges of the mounting plate to accommodate screws for screwing the mounting plate and hence the cylinder liner support securely to the lower surface of the cylinder block.

6. The arrangement according to claim 4, wherein the fastening holes in the edges of the mounting plate are placed in pairs on opposite side edges of the mounting plate, with each pair of holes disposed in a plane which is perpendicular to the mounting plate and to the longitudinal direction of the row of supporting sleeves and passing centrally between adjacent supporting sleeves, the adjacent supporting sleeves being connected to one another by portions of mutually adjoining walls defining the sleeves.

7. The arrangement according to claim 5, wherein the fastening holes in the edges of the mounting plate are placed in pairs on opposite side edges of the mounting plate, with each pair of holes disposed in a plane which is perpendicular to the mounting plate and to the longitudinal direction of the row of supporting sleeves and passing centrally between adjacent supporting sleeves, the adjacent supporting sleeves being connected to one another by portions of mutually adjoining walls defining the sleeves.

8. The arrangement according to claim 1, wherein the sleeves have sleeve wall regions where a pair of mutually adjacent supporting sleeves are connected to one another, the smallest thickness of the sleeve wall regions common to adjacent supporting sleeves being at least as great as the sleeve wall thickness elsewhere of the supporting sleeves.

9. The arrangement according to claim 1, wherein the removable cylinder liner support is made of the same material as the cylinder block.

10. The arrangement according to claim 1, wherein the cylinder liner support comprises aluminum.

11. The arrangement according to claim 2, wherein the sleeves have sleeve wall regions where a pair of mutually adjacent supporting sleeves are connected to one another, the smallest thickness of the sleeve wall regions common to adjacent supporting sleeves being at least as great as the sleeve wall thickness elsewhere of the supporting sleeves.

12. The arrangement according to claim 6, wherein the sleeves have sleeve wall regions where a pair of mutually adjacent supporting sleeves are connected to one another, the smallest thickness of the sleeve wall regions common to adjacent supporting sleeves being at least as great as the sleeve wall thickness elsewhere of the supporting sleeves.

13. The arrangement according to claim 7, wherein the sleeves have sleeve wall regions where a pair of mutually adjacent supporting sleeves are connected to one another, the smallest thickness of the sleeve wall regions common to adjacent supporting sleeves being at least as great as the sleeve wall thickness elsewhere of the supporting sleeves.

14. The arrangement according to claim 1, wherein the cylinder liner support is provided in an in-line engine.

15. The arrangement according to claim 1, wherein the cylinder liner support is provided in a vee-engine.

* * * * *